United States Patent [19]

Sargent

[11] 3,935,571

[45] Jan. 27, 1976

[54] ELECTRO-VISUAL INDICATORS

[75] Inventor: Raymond W. Sargent, Shelburne, Vt.

[73] Assignee: Simmonds Precision Products, Inc., Tarrytown, N.Y.

[22] Filed: Mar. 28, 1974

[21] Appl. No.: 455,741

[52] U.S. Cl. ..... 340/373; 340/378 R; 340/324 R; 340/336

[51] Int. Cl.[2] ..... G08B 5/00

[58] Field of Search ..... 340/373, 378 R, 324 R, 340/336; 350/267

[56] References Cited

UNITED STATES PATENTS

| | | | |
|---|---|---|---|
| 3,648,269 | 3/1972 | Rosenweig | 340/373 |
| 3,787,839 | 1/1974 | Fayling | 340/373 X |

*Primary Examiner*—Harold I. Pitts
*Attorney, Agent, or Firm*—Edwin E. Greigg

[57] ABSTRACT

An electro-visual indicator comprises a space having two parts. A transparent member covers one of the two parts. A magnetic fluid partially fills the space. An electromagnet is disposed so as to set up a magnetic field within the other part of the space when energized, the magnetic field being effective to draw the magnetic fluid into that part. The shape of the part behind the member is so defined that a capillary action is effective to draw the magnetic fluid into that part when the electromagnet is de-energized. The presence and absence of fluid within the part of the space visible through the transparent member are externally visually distinguishable through the member to thereby indicate the state of energization of the electromagnet. The fluid is given a color which contrasts with the background color of the space.

11 Claims, 3 Drawing Figures

ELECTRO-VISUAL INDICATORS

BACKGROUND OF THE INVENTION

1. Field of the Invention

The invention relates to electro-visual indicators which present a visual output indicating whether they are electrically energized.

2. Prior Art

Known in the art are electro-visual indicators which operate via the intermediary of a mechanical part movable in response to the electrical energization of, for example, an electromagnetic coil. Movement of the mechanical part typically renders visible or not visible a display or character indicating whether the device is electrically energized. Such indicators, however, suffer from the disadvantage that movable mechanical parts are subject to wear and to effects of vibrations.

Also known in the art are electro-visual indicators which essentially comprise an electrically energizable light emitting source, light from which can either be used as an indication in itself of energization of the indicator, or to define characters representative of information requiring display. Indicators of this type are disadvantageous in that they are only able to give a positive indication when the indicator is actually energized and in that they typically have high power consumption requirements.

It is an object of the invention to provide an improved electro-visual indicator. It is a further object of the invention to provide an electro-visual indicator having no movable mechanical parts and which has a low power consumption. It is a still further object of the invention to provide an electro-visual indicator capable of providing a positive indication either when the indicator is energized or when the indicator is not energized.

SUMMARY OF THE INVENTION

According to the invention there is provided an electro-visual indicator, comprising a housing, means defining a closed-off space within the housing, a magnetic fluid partially filling the said space and having a predetermined optical characteristic, means in the housing defining a viewing window opening into part only of the said space and covered by light transmitting material, and electromagnetic means in the housing energizable to move the magnetic fluid in the space in a manner which is visually distinguishable through the said window to provide an indication of the state of energization of the electromagnetic means.

According to the invention there is also provided an electro-visual indicator, comprising a cylindrical housing of magnetic material which is closed off at one end and has a peripheral opaque flange at the other end to define a viewing window, light transmitting material sealingly fixed in the window space, a disc-shaped first pole piece mounted co-axially within the housing and having a surface closely spaced behind the said light transmitting material and sized so as to define a first gap between it and the light transmitting material and a second, annular, gap in communication with the first gap and behind the opaque flange on the housing and between the periphery of the first pole piece and the housing, an annular, second pole piece co-axially mounted around the annular gap, sealing means for sealing the annular gap such that the annular gap and the said first gap together define a closed space, a magnetic fluid partially filling the said closed space and tending to flow into the said first gap by capillary action and having a predetermined color which contrasts with the color of the said surface of the disc-shaped first pole piece behind the window, an electromagnetic coil mounted in the housing and electrically energizable to set up a radially directed magnetic flux which travels through the housing and between the first and second pole pieces to magnetically attract the magnetic fluid out of the first gap and into the second, annular gap.

BRIEF DESCRIPTION OF THE DRAWING

An electro-visual indicator embodying the invention will now be described, by way of example only, with reference to the accompanying diagrammatic drawing in which.

DESCRIPTION OF THE PREFERRED EMBODIMENT

Figure 1:
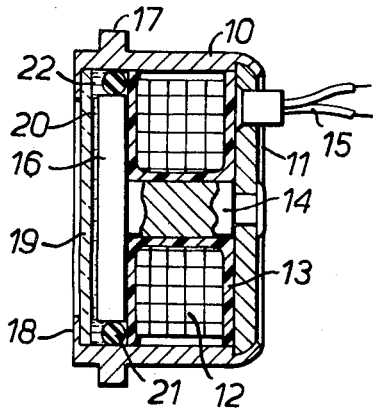
FIG. 1 is a cross-section of the electro-visual indicator.

As shown in FIG. 1, the indicator comprises a housing 10 of a generally cylindrical form which is sealed at one end by a back plate 11. The housing 10 and back plate 11 are of a ferrous metal. An electromagnetic coil 12 is wound on a bobbin 13 disposed within the housing 10. The bobbin 13 has a central core 14 of a suitable magnetic material. Electric leads 15 pass through the back plate 11 to facilitate connection of the coil 12 into an external circuit. A disc-shaped pole piece 16 is disposed adjacent one end of the coil and concentric with the housing 10. The diameter of the pole piece 16 is somewhat less than the internal diameter of the housing 10. Formed on the housing 10 adjacent to and encompassing the pole piece 16 is an annular pole piece 17. The coil 12, bobbin 13, central core 14, housing 10 and pole pieces 16 and 17, together form an electromagnet.

At its end further from the back plate 11, the housing 10 has a flanged lip 18 formed around its inner edge. A thin transparent glass lens or window 19 is secured, for example by adhesive, in sealing relation with and behind the lip 17. The indicator is so constructed that the glass window 19 and the opposed front face of the disc-shaped pole piece 16 define a narrow space 20 therebetween.

The peripheral gap between the disc-shaped pole piece 16 and the encompassing annular pole piece 17 is sealed by an elastomeric packing gland 21, for example a rubber O-ring. The space defined by the glass window 19, the housing 10, the packing gland 21 and the pole piece 16 and which includes the narrow space 20 is partially filled with a magnetic fluid 22. One property of the fluid 22 is that it is attracted into a magnetic field.

Figure 2:
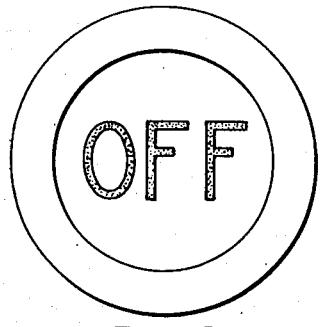
FIG. 2 is a front view of the indicator in the absence of electric power supply to the indicator.

A legend, indicating whether electric power is being supplied to the indicator, is formed, for example by painting, on the glass window 19. The front face of the disc-shaped pole piece 16 is colored in the same or similar color to that of the characters. The color of the magnetic fluid 22 is such as to contrast with the color of the characters formed on the glass window 19. Typically, the legend formed on the glass window 19 is the word 'OFF' (FIG. 2) and is painted on in a durable dull black color paint which is also applied to the front face of the pole piece 16; in this case a red colored magnetic fluid 22 can be advantageously used.

In the absence of an electrical power supply to the coil 12 via the leads 15, the magnetic fluid 22 is drawn into the narrow space 20 as a result of capillary action. The characters of the legend formed on the glass window 19 will thus be contrasted against the background formed by the magnetic fluid and will be clearly visible in suitable ambient light conditions; in the example being considered, the legend OFF will be seen in black letters on a red background.

Figure 3:
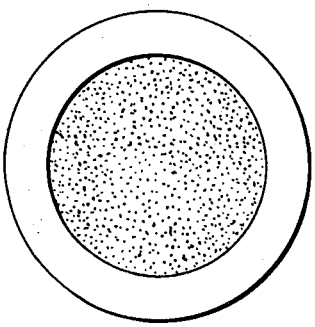
FIG. 3 is a front view of the indicator with electric power supplied to the indicator.

When electric power is supplied to the indicator via the leads 15, the coil 12 is energized and a radial magnetic field is set up in the space between the disc-shaped pole piece 16 and the annular pole piece 17 formed in the housing 10. The magnetic circuit is provided by the housing 10, the back plate 11, the central core 14 and the disc-shaped pole piece 16. The magnetic fluid 22 is attracted towards the radial magnetic field and is thus drawn out of the narrow space 20. The characters formed on the glass window 19 will now be viewed against a background formed on the glass window 19 will now be viewed against a background formed by the front face of the disc-shaped pole piece 16. Since there is substantially no color contrast between the characters of the legend and the front face of the pole piece 16 the characters are not visible (FIG. 3) and such a condition indicates that power is applied to the indicator.

On de-energization of the coil 12, the magnetic fluid 22 is drawn back into the narrow space 20 by capillary action thus rendering the legend visible once more.

Magnetic fluid suitable for use as the magnetic fluid 22 employed in the described indicator is known in a range of viscosities, magnetic and temperature properties, and colors. Any suitable magnetic fluid can be used as desired.

Although the described indicator operates such that when not energized a positive indication is presented (e.g., the word OFF is visible), it is possible to adapt the indicator by use of a magnetic fluid 22 of a color such that the characters on the glass window 19 are not visible when the coil 12 is de-energized and the magnetic fluid is acting as a background for the characters. In this case the front face of the pole piece 16 is painted in a color contrasting with that of the characters formed on the glass window 19 so that these characters will stand out against the background of the front face of the pole piece when the coil 12 is energized.

Further, the indicator can be constructed so that the narrow space 20 into which the magnetic fluid is drawn in the absence of energization of the coil 12 is not behind the glass window 19 and fluid will thus be drawn away from the window 19 by capillary action. In this case, the magnetic circuit of the indicator is arranged so as to produce a magnetic field on energization of the coil 12 which draws the magnetic fluid back behind the glass window 19. Contrast between characters formed on the glass window 19 and the background to the characters is provided by any of the hereinbefore described methods.

It is also possible to dispense with the characters formed on the window 19, visual indication of the state of energization of the indicator being provided solely by the color or other optical characteristic visible through the window which is determined by the presence or absense of the magnetic fluid in the field of view behind the window.

The described electro-visual indicators can be advantageously used to visually indicate electric power failure in a circuit into which the indicator is connected, for example an aircraft engine instrumentation circuit.

The indicators are advantageous in that they do not contain any mechanical moving parts which are subject to wear and to effects of vibration. The indicators are also compact, have a low power consumption and are readily adaptable to instrument display utilizing integral lighting techniques. The flat front view presentation provided by the indicators facilitates a better readability as compared with drum type indicators.

What I claim:

1. An electro-visual indicator,
comprising a housing,
a magnetic fluid partially filling
said housing and having a predetermined optical characteristic,
means defining a space within the housing having a first part of such cross-section that the magnetic fluid tends to flow into it by capillary action and a second part which is so positioned that the magnetic fluid may be drawn into this part by a magnetic field,
means in the housing defining a viewing window opening into part only of the said space and covered by light transmitting material, and
electromagnetic means in the housing energizable to provide a magnetic field for moving the magnetic fluid in said space in a manner which is visually distinguishable through the said window to provide an indication of the state of energization of the electromagnetic means.

2. An indicator according to claim 1, in which the optical characteristic of the said fluid is a predetermined color which contrasts with the background color of the said space as viewed through the window.

3. An indicator according to claim 2, including a legend formed on the light transmitting material and of one said color so as to be effectively visible or invisible according to the position in the said space of the magnetic fluid.

4. An indicator according to claim 1, in which
the said housing is generally cylindrical in shape with one of its ends having a peripheral opaque flange defining the said window,
the means defining the said closed-off space defines the said first part of the space behind the window and the said second part of the space behind the opaque flange, and
the electromagnetic means is mounted in the housing to produce a radially directed magnetic field in the said space whereby to move the fluid between a first position in which it is substantially wholly held behind the peripheral flange and a second position in which it is spread across the inside of the light transmitting material covering the window.

5. An indicator according to claim 4, in which the electromagnetic means comprises
a disc-shaped first pole piece mounted coaxially within the housing adjacent the said space and with its periphery spaced radially inward of the housing to define an annular gap which is behind the peripheral flange of the housing,
an annular, second, oppositely polarized, pole piece mounted coaxially with the first pole piece and surrounding the said annular gap, and coil means and magnetic circuit means for setting up the said radially directed magnetic field between the first and second pole pieces.

6. An indicator according to claim 5, including a coil bobbin mounted axially within the housing and carrying the said coil means.

7. An indicator according to claim 6, in which the second pole piece forms part of the housing which is made of magnetic material to form at least part of the magnetic circuit means.

8. An indicator according to claim 5, in which a face of the said disc-shaped pole piece has a predetermined color and is visible through the said window when the magnetic fluid is held behind the said peripheral flange of the housing, and the said optical characteristic of the magnetic fluid is its color which contrasts with the color of the said face of the disc-shaped pole piece.

9. An indicator according to claim 8, including a legend formed on the light-transmitting material in one of the two said colors so as to be visible through the window when the magnetic fluid is held in one said position and to be substantially invisible through the window when the magnetic fluid is held in the other said position.

10. An electro-visual indicator, comprising a cylindrical housing of magnetic material which is closed off at one end and has a peripheral opaque flange at the other end to define a viewing window, light transmitting material sealingly fixed in the window space, a disc-shaped first pole piece mounted coaxially within the housing and having a surface closely spaced behind the said light transmitting material and sized so as to define a first gap between it and the light transmitting material and a second, annular, gap in communication with the first gap and behind the opaque flange on the housing and between the periphery of the first pole piece and the housing, an annular, second pole piece co-axially mounted around the annular gap, sealing means for sealing the annular gap such that the annular gap and the said first gap together define a closed space, a magnetic fluid partially filling the said closed space and tending to flow into the said first gap by capillary action and having a predetermined color which contrasts with the color of the said surface of the disc-shaped first pole piece behind the window, an electromagnetic coil mounted in the housing and electrically energizable to set up a radially directed magnetic flux which travels through the housing and between the first and second pole pieces to magnetically attract the magnetic fluid out of the first gap and into the second, annular gap.

11. An indicator according to claim 10, including a legend formed on the light transmitting material in one of the said two colors so as to be visible through the window when the magnetic fluid is present in one said gap and to be substantially invisible through the window when the magnetic fluid has flowed into the other said gap.

* * * * *

UNITED STATES PATENT AND TRADEMARK OFFICE

CERTIFICATE OF CORRECTION

PATENT NO. : 3,935,571

DATED : January 27, 1976

INVENTOR(S) : Raymond W. Sargent

It is certified that error appears in the above–identified patent and that said Letters Patent are hereby corrected as shown below:

The sentence beginning at line 20, column 3, should read as follows:

> The characters formed on the glass window 19 will now be viewed against a background formed by the front face of the disc-shaped pole piece 16.

Signed and Sealed this

Seventh Day of September 1976

[SEAL]

*Attest:*

RUTH C. MASON
*Attesting Officer*

C. MARSHALL DANN
*Commissioner of Patents and Trademarks*